US005970687A

United States Patent [19]

Katayama et al.

[11] Patent Number: 5,970,687

[45] Date of Patent: Oct. 26, 1999

[54] PACKAGE CONTAINER FORMING APPARATUS FLAP

[75] Inventors: Hiroshi Katayama; Kojiro Hayashi; Tetsuya Iuchi; Michio Ueda, all of Tokushima-ken, Japan

[73] Assignee: Shikoku Kakoki Co., Ltd, Tokushima-ken, Japan

[21] Appl. No.: 08/925,650

[22] Filed: Sep. 9, 1997

[30] Foreign Application Priority Data

Sep. 17, 1996 [JP] Japan ..... 8-244900

[51] Int. Cl.[6] ..... B65B 9/00

[52] U.S. Cl. ..... 53/451; 53/374.09; 53/551

[58] Field of Search ..... 53/451, 551, 370.6, 53/374.9, 373.6

[56] References Cited

U.S. PATENT DOCUMENTS

| | | | |
|---|---|---|---|
| 2,481,611 | 9/1949 | Moore | 53/526 |
| 3,426,499 | 2/1969 | Paige | 53/451 |
| 4,004,398 | 1/1977 | Larsson et al. | 53/551 |
| 4,235,064 | 11/1980 | Wenger | 53/451 |
| 4,411,122 | 10/1983 | Cornish et al. | 53/122 |
| 4,450,669 | 5/1984 | Rapparini | 53/551 |
| 4,617,779 | 10/1986 | Nygren et al. | 53/551 |
| 4,662,978 | 5/1987 | Oki | 53/551 |
| 4,873,815 | 10/1989 | Tetenborg et al. | 53/370.6 |
| 5,001,891 | 3/1991 | Abate | 53/551 |
| 5,067,310 | 11/1991 | Yamanaka | 53/551 |
| 5,279,094 | 1/1994 | Odom et al. | 53/370.6 |
| 5,313,766 | 5/1994 | Rimondi et al. | 53/451 |

FOREIGN PATENT DOCUMENTS

| | | |
|---|---|---|
| 58-193206 | 11/1983 | Japan . |
| 61-93010 | 5/1986 | Japan . |
| 5-32208 | 9/1993 | Japan . |
| 1012867 | 12/1965 | United Kingdom . |

*Primary Examiner*—Jessica J. Harrison
*Assistant Examiner*—John Paradiso
*Attorney, Agent, or Firm*—Smith, Gambrell & Russell; Beveridge, DeGrandi, Weilacher & Young Intellectual Property Group

[57] ABSTRACT

A package container forming flap apparatus capable of forming a tubular packaging material in a rectangular shape in cross section with reliability and accuracy. The package container forming flap apparatus lateral seal bars for laterally sealing a tubular packaging material, a pair of opposing fixed plates which are disposed respectively over each lateral seal bar in parallel with a seal surface thereof, forming arms for turning about axes which are parallel to a longitudinal direction of the tubular packaging material, and movable plates which are secured to the forming arms and together with the fixed plates to shape the tubular packaging material in a rectangular shape in cross section.

13 Claims, 5 Drawing Sheets

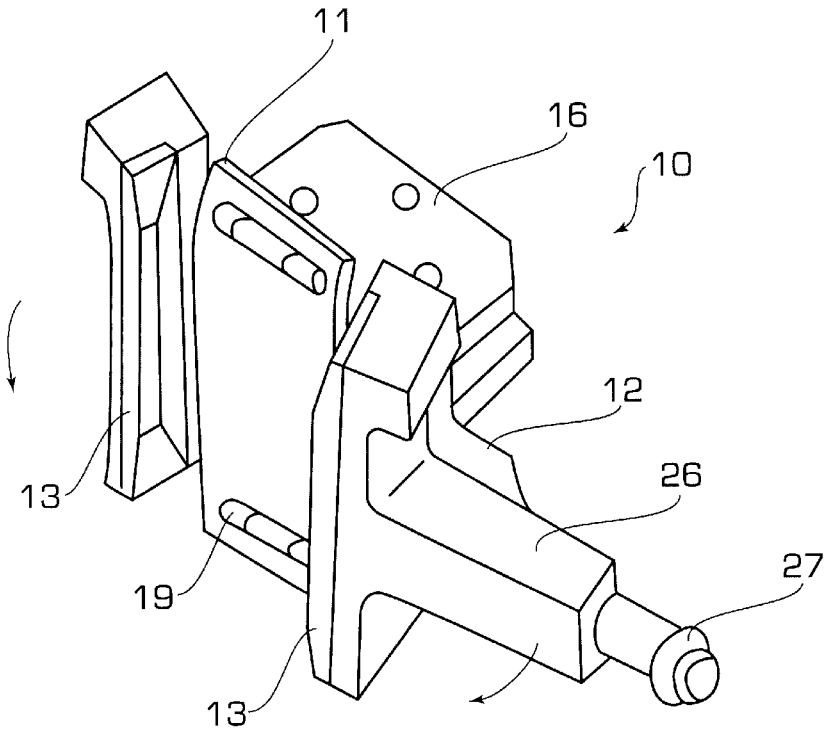
FIG. 6
FIG. 7
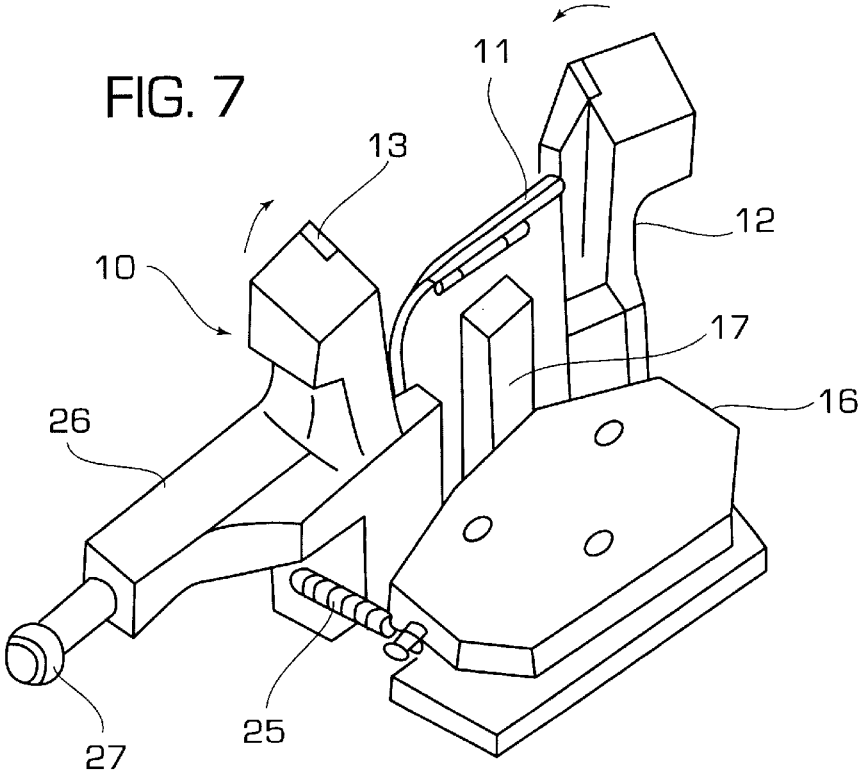

PACKAGE CONTAINER FORMING APPARATUS FLAP

BACKGROUND OF THE INVENTION

1.Field of the Invention

The present invention relates to a package container forming flap apparatus in a filling and packaging apparatus for manufacturing package containers each having a rectangular shape in cross section and filled with a fluid content such as juice, etc. and a method of forming the package container using the same.

2. Prior Art

There is known a conventional filling and packaging apparatus comprising a rewinder for supporting a packaging material web in a rolled state, a winding apparatus for winding the web in order from the rewinder, a tube-forming apparatus for forming the wound web in a tubular shape after sterilizing it, a liquid supply pipe for filling a fluid content in the tubular shaped packaging material web, and a container-forming apparatus for laterally sealing the tubular web filled with the fluid content and cutting a sealed part of the tubular web to continuously form pillow-like containers each having a rectangular shape in cross section while downwardly supplying the tubular web by the length corresponding to one container, and a container shaping apparatus for bending each end part of the pillow-like containers to shape each pillow-like container in a parallelepiped container to be finally obtained (as disclosed in JP-A 58-193206 and JP-A 61-93010).

As a package container forming flap of a container forming apparatus in such a filling and packaging apparatus, it is known that a tubular body is formed in a rectangular shape by the movement of two pistons from two directions crossing at right angles with opposing plates after the tubular body is supplied between the opposing plates (U.K. Patent Number 1,012,867), or a tubular packaging material is formed in a box-shape from the bottom to the top thereof using longitudinal forming flap members 4 which turn longitudinally about axes 3 disposed in a direction parallel with a direction crossing at right angles with a longitudinal direction of the tubular packaging material 2 over the lateral seal bars 1 as shown in FIG. 1 when forming a liquid filling and packaging container by filling a content in a tubular packaging material web, laterally sealing and cutting this web after the plate-shaped packaging material web is formed in the tubular packaging material web (JP-A 58-193206) or a protrusion and a recess are provided on opposing surfaces of the forming flap members for forming the tube in a rectangular shape (JP-A 5-32208).

However, there are following drawbacks in these forming flaps.

In the forming flap as disclosed in U.K. Patent Number 1,012,867, the structure of the forming flap is made large and complex since the tubular body is formed in a rectangular shape by the plates and the pistons.

In the forming flap disclosed in JP-A 58-193206, since the forming flap members are turned in the longitudinal direction when the tubular shape is changed to a box-shape by the forming flap members, a soft packaging material such as paper is nipped between contact surfaces of the opposing forming flap members in the longitudinal direction, so that a fold or wrinkle 5 is produced at the side surfaces of the tubular packaging material 2 as shown in FIG. 2, which causes a problem that an external appearance is deteriorated, the tubular packaging material 2 does not have an intended size of the container, and proper inner capacity of the container is not obtained, thereby impairing a product value.

Further, since the forming flap members are turned approach to each other in a longitudinal direction thereof to form the tubular packaging material from a circular shape in cross section to a rectangular shape in cross section, the container has an inverted trapezoidal shape in longitudinal cross section because of the adjustment of the inner capacity of the container, which causes a problem of inconvenience of packaging or carriage of the container. Still further, the surface of the packaging material web is liable to be damaged because the inner surfaces of the forming flap members and the web slide when forming the tubular packaging material web.

In the forming flap as disclosed in JP-A 5-32208, the protrusion and the recess are defined on the contacting surfaces of the opposing forming flap members to improve the drawback of JP-A 58-193206 that the longitudinal forming flap members nip the packaging material web in the longitudinal direction thereof, whereby the nipping of the packaging material web can be prevented to some extent but it is not completely prevented. Further, the problem of inconvenience of the shape of the container that the container has the inverted trapezoidal shape in longitudinal cross section has not been solved so far.

SUMMARY OF THE INVENTION

It is an object of the invention to solve all the problems of the conventional forming flap apparatus and to provide a package container forming flap to form or shape a tubular packaging material in a rectangular shape in cross section with reliability and accuracy.

The inventors of this application devoted themselves to study every possibility of the forming flap of this type dismissing a fixed idea about the conventional forming flap, and have found that the problem of the conventional forming flap can be solved by employment of a system for turning forming flap members about axes which are in parallel with the longitudinal direction of the packaging material web instead of the system for turning the forming flap members about axes which are provided in parallel with a direction crossing at right angles with the longitudinal direction of the conventional packaging material web, and they completed this invention.

That is, the present invention relates to a package container forming flap comprising lateral seal bars for laterally sealing a tubular packaging material, a pair of opposing fixed plates which are disposed over the lateral seal bars in parallel with a seal surface of each lateral seal bar, forming arms for turning about axes which are in parallel with a longitudinal direction of the tubular packaging material, and movable plates which are secured to the forming arms and cooperate with the fixed plates to shape the tubular packaging material in a rectangular shape in cross section.

Further, the present invention relates to the package container forming flap, wherein the forming arms are paired at the right and left, and wherein when one forming arm is turned by a cam mechanism, the other forming arm is interlocked with one forming arm to be turned in an opposite direction, to that further comprising a means for shunting the movable plates in a position not to interfere with the tubular packaging material, to that wherein the fixed plates have rollers for guiding the tubular packaging material, and to that wherein central portions of surfaces of each fixed plate contacting the tubular packaging material and/or central portions of surfaces of each movable plate contacting the tubular packaging material respectively protrude toward the tubular packaging material from the peripheries thereof.

Still further, the present invention relates to a filling and packaging apparatus provided with the package container forming flap including the fixed plates and movable plates set forth above.

More still further, the present invention relates to a method of forming package containers comprising forming a tubular packaging material in a rectangular shape in cross section by a package container forming flap comprising a pair of opposing fixed plates which are disposed over lateral seal bars in parallel with a seal surface thereof, wherein each lateral seal bar laterally seals the tubular packaging material, and movable plates which are secured to the forming arms wherein the forming arms turn about axes which are in parallel with a longitudinal direction of the tubular packaging material, and also relates to the method of forming package containers wherein the amount of inner volume of each package container is finely adjusted by adjusting a turning angle defined between the forming arms.

As the lateral seal bars for laterally sealing the tubular packaging material over which the forming flap of the present invention is provided, it is possible to exemplify lateral seal bars as disclosed in JP-A 58-193206 provided with a cutter for cutting the laterally sealed part, and lateral seal bars as disclosed in JP-A 61-93010, which are respectively known before filing this application, and lateral seal bars having no cutting mechanism in a high speed filling and packaging apparatus which is invented by the present inventors (see JP-A 8-244707).

The filling and packaging apparatus according to the present invention features the package container forming flap, and hence other mechanisms of this filling and packaging apparatus of this type, for example, a carrying mechanism of a packaging material web, a sterilizing mechanism of the packaging material web, a longitudinal sealing mechanism for forming a plate-shaped web in a tubular shape, and a mechanism for carrying out the formed packaging body, etc. are not limited specifically, and hence the filling and packaging apparatus of the present invention can employ any mechanism including the known mechanisms. However if the present invention is applied to the high speed filling and packaging apparatus which has been invented by the present inventors (see JP-A 8-244707), the performance of the package container forming flap of the present invention can be sufficiently exerted.

BRIEF DESCRIPTION OF THE DRAWINGS

FIG. 6 is a perspective view of the package container forming flap as viewed from the front thereof; and FIG. 7 is a perspective view of the package container forming flap as viewed from the rear thereof.

PREFERRED EMBODIMENT OF THE INVENTION

Figure 1:
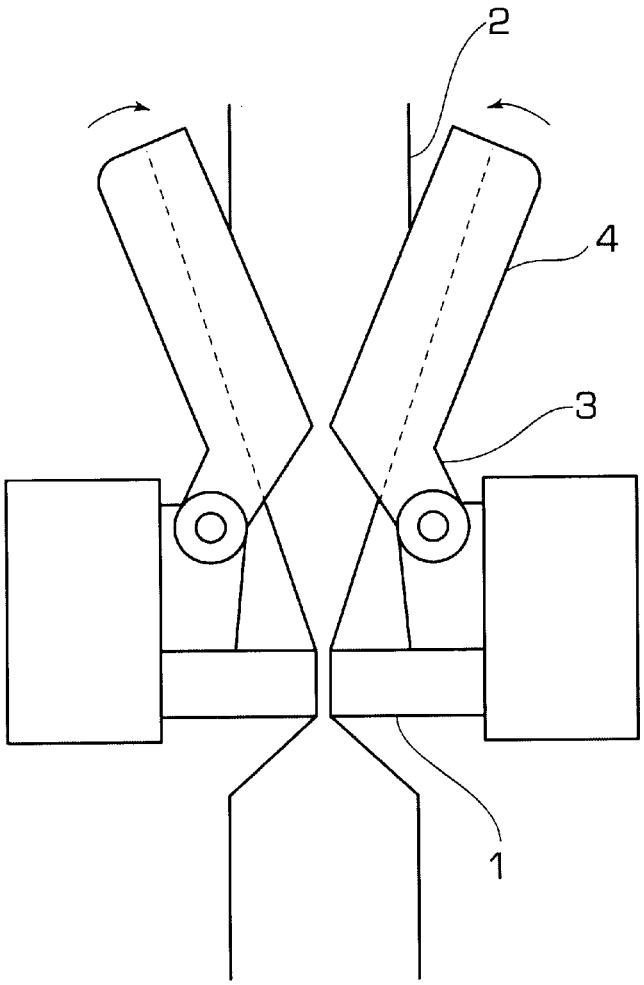
FIG. 1 PRIOR ART
FIG. 1 is a schematic longitudinal sectional view of conventional package container forming flap (apparatus)
Figure 2:
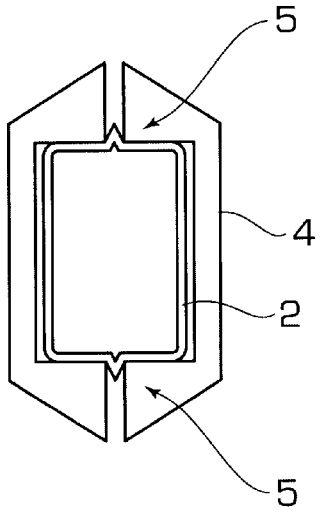
FIG. 2 PRIOR ART
FIG. 2 is a schematic lateral sectional view of a packaging material employed by the conventional package container forming flap.
Figure 3:
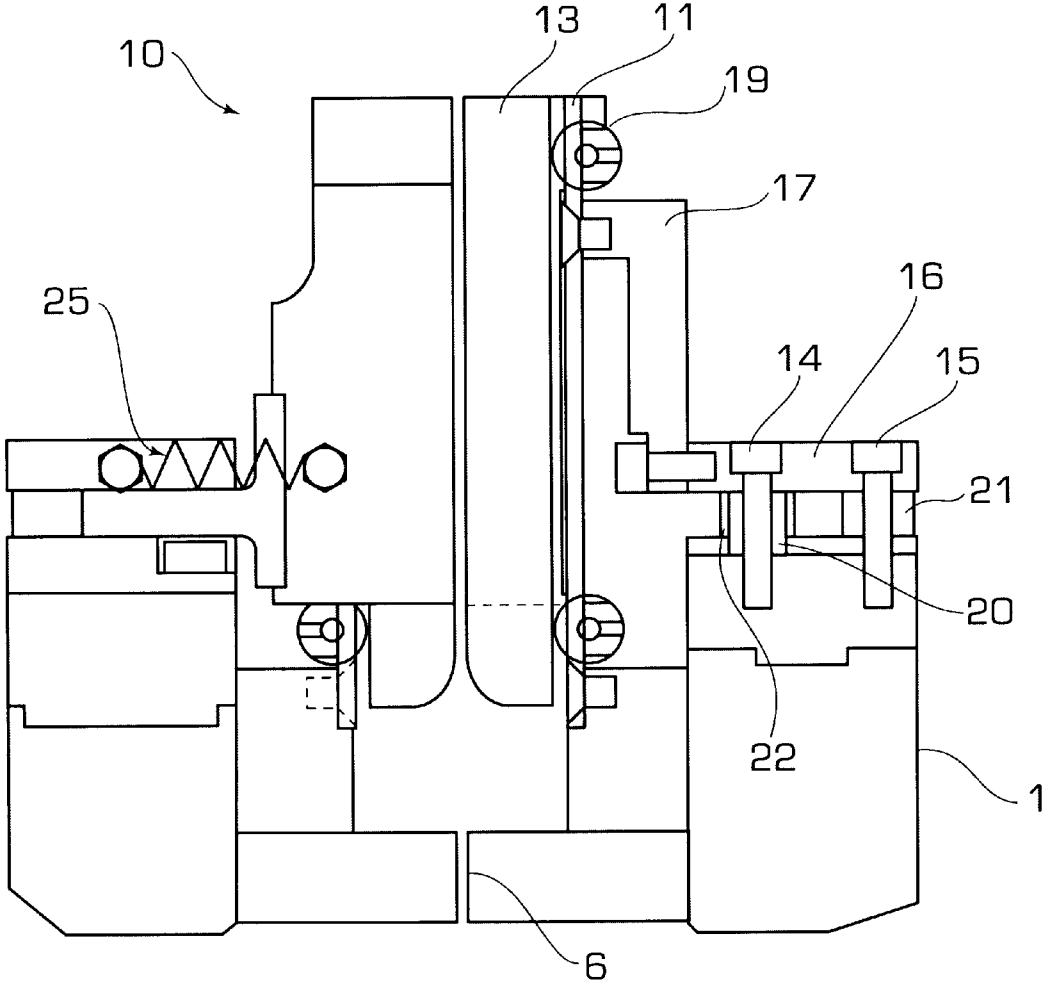
FIG. 3 is a longitudinal sectional view of a package container forming flap (apparatus) according to the present invention.
Figure 4:
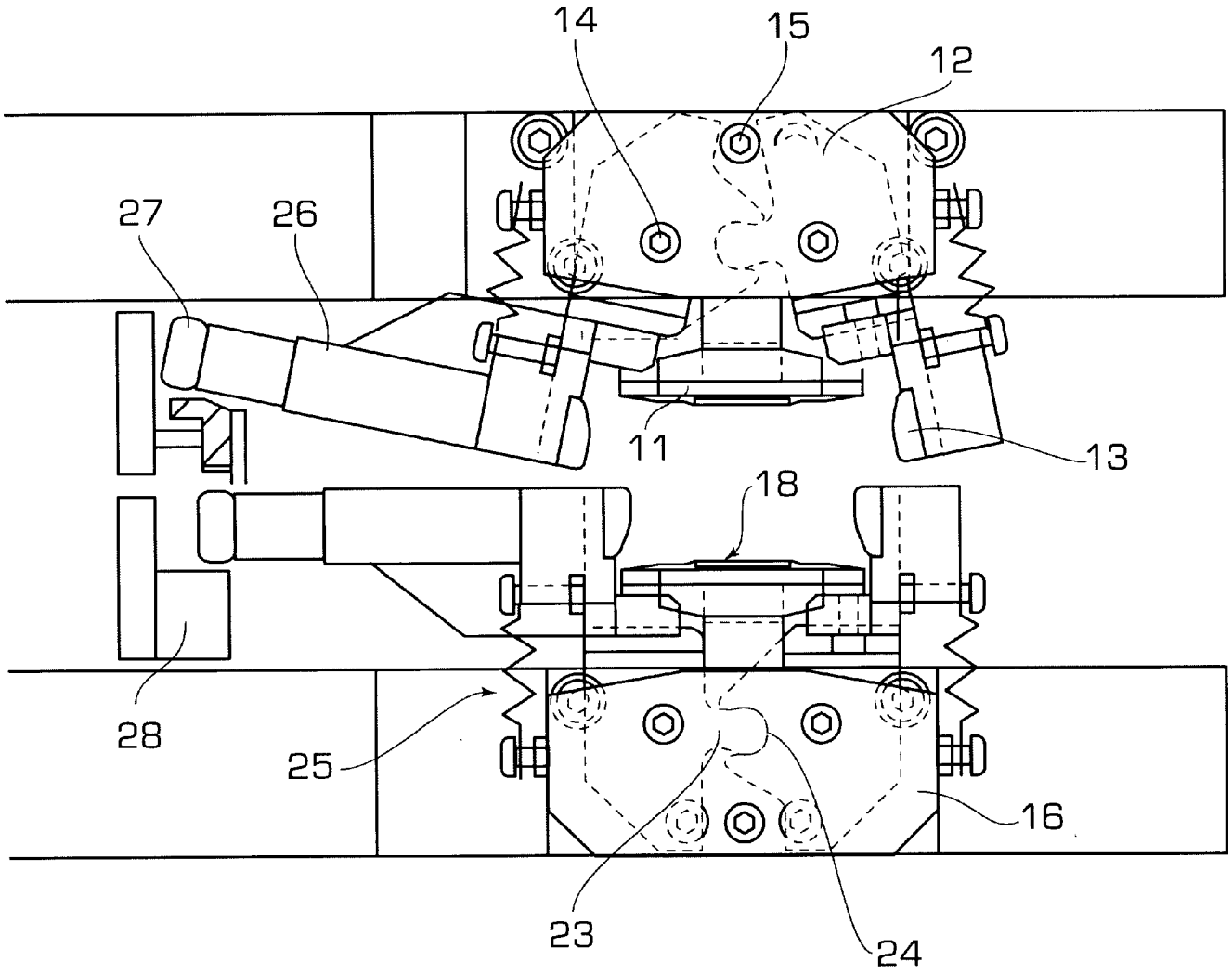
FIG. 4 is a plan view of the package container forming flap in FIG. 3.

A package container forming flap apparatus according to a preferred embodiment of the present invention will be described with reference to the attached drawings. The present invention is however not limited to the embodiment set forth hereunder.

A package container forming flap (apparatus) 10 according to the present invention is disposed over lateral seal bars 1 as shown in FIGS. 3 to 7. For example, as disclosed in JP-A 61-93010, each lateral seal bar 1 is vertically movable in the longitudinal direction of a tubular packaging material by the vertical movement of one shaft, not shown, and repeats the vertical movement wherein it lowers by the turning of the shaft in a state where it nips the tubular packaging material in the vicinity of a top dead center, and it rises in a state where it releases the nipping of the tubular packaging material in the vicinity of a bottom dead center. The package container forming flap 10 of the present invention forms the tubular packaging material in a rectangular one in cross section while the lateral seal bar 1 moves the tubular packaging material downward while it nips the tubular packaging material.

The package container forming flap 10 comprises a pair of fixed plates 11 which are disposed over the lateral seal bar 1 and oppose each other, movable plates 13 respectively secured to each one end of forming arms 12 which turn about axes which axes are in parallel with the longitudinal direction of the tubular packaging material.

Each fixed plate 11 of the package container forming flap 10 is disposed over the lateral seal bar 1 and is disposed in parallel with a seal surface 6 of the lateral seal bar 1 by a plate 16 and a bracket 17 which are respectively secured to the upper surface of the lateral seal bar 1 via bolts 14 and 15, and each fixed plate 11 has dimensions which are substantially the same as the height and width of a rectangular parallelepiped body which is a final shape of the package container.

Each fixed plate 11 has a central part 18 which contacts the tubular packaging material, and the central part 18 has a structure wherein it protrudes toward the tubular packaging material from the periphery thereof. If the central part 18 does not have such a structure, the inner capacity of the container is reduced at the bottom thereof when both ends of the tubular packaging material are bent and tucked toward the bottom of the container in case of shaping the tubular packaging material in a rectangular parallelepiped container which is the final shape by bending the ends of the container, but the rectangular parallelepiped container is swollen at the side surfaces thereof, whereby the tubular packaging material is not formed in an intended rectangular parallelepiped shape. However, if the central part 18 of the fixed plate 11 where it contacts the tubular packaging material is structured to protrude toward the tubular packaging material from the periphery thereof, the container is formed in such a shape that it is slightly recessed at the side surfaces thereof but such recess is corrected when both ends of the tubular packaging material are bent and tucked toward the bottom surface of the container, and hence the final product has an intended rectangular parallelepiped shape.

One roller, preferably two rollers 19 are disposed on the fixed plates 11 in a vertical direction thereof so as to reduce the resistance which is generated when the fixed plates and the tubular packaging material contact each other or the resistance which is generated when the tubular packaging material slides on the fixed plates 11.

The movable plates 13 of the package container forming flap 10 according to the present invention are respectively secured to each end of a pair of forming arms 12, and they have the longitudinal dimension which is substantially the same as the height of the rectangular parallelepiped body of the container as the shape of the final product, and the lateral dimension which is substantially a half of the width of the rectangular parallelepiped body, like the fixed plates 11. Each movable plate 13 is structured to protrude from the periphery thereof at the central part thereof where it contacts the tubular packaging material in the same manner as explained in relation to each fixed plate 11.

Each forming arm 12 of the package container forming flap 10 is engaged in a space at a part thereof which space is defined between the upper surface of the lateral seal bar 1 and the plate 16 by spacers 20 and 21. Each forming arm 12 can be turned about the bolt 14 as a central axis which is disposed in parallel with the longitudinal direction of the packaging material web via a bush 22. When each forming arm 12 is turned, each movable plate 13 provided at one end of the forming arm 12 is also turned about the bolt 14 as the central axis.

Figure 5:
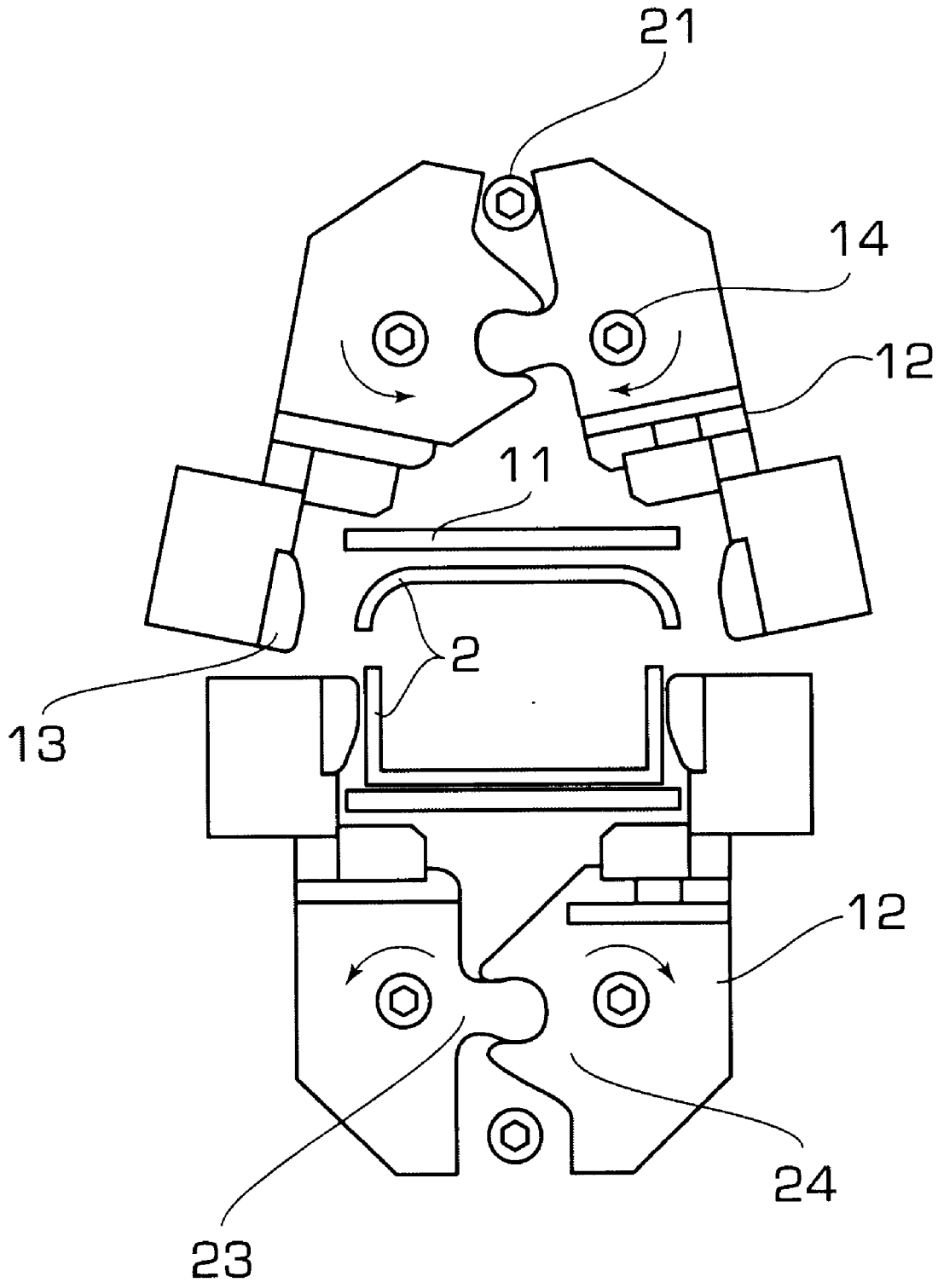
FIG. 5 is a schematic lateral sectional view of the package container forming flap in FIG. 3.

As shown in FIG. 5, the forming arms 12 are respectively paired over one side of the lateral seal bar 1 to oppose each other at the right and left thereof, and each protrusion 23 of one forming arm 12 and each recess 24 of the other forming arm 12 are engaged with each other so that the other forming arm 12 is interlocked with one forming arm 12 to be turned in an opposite direction when one forming arm 12 is turned by a cam mechanism, etc.

At least one of the forming arms 12 and the plate 16 are connected with each other by a spring 25. When a force from the cam mechanism, etc. is not applied to the forming arms 12, the forming arms 12 are open by a biasing or resilient force of the spring 25. When one end of the forming arms 12 contacts the spacer 21, both forming arms 12 do not further open. At this time, the movable plates 13 are shunted in a position not to interfere with the tubular packaging material 2, where the movable plates 13 are most moved away from each other (see the upper portions in FIGS. 4 and 5)

Each lever 26 protrudes from one forming arm 12 and each cam follower 27 is secured to the tip end of the lever 26. Each plate cam 28 is disposed on the filling and packaging apparatus along a position which is in parallel with the vertically movable direction of the lateral seal bar 1.

The vertically movable lateral seal bar 1 nips the tubular packaging material in the vicinity of its top dead center, and lowers toward its bottom dead center while remaining nipping the tubular packaging material. During the lowering of the lateral seal bar 1, a pair of opposing fixed plates 11 contact the tubular packaging material and they are in parallel with each other. After the fixed plates 11 are in parallel with each other, the cam follower 27 lowers to contact the plate cam 28 so as to turn one forming arm 12 while the other forming arm 12 is interlocked with one forming arm 12 and is turned in the opposite direction so that both forming arms 12 are in a closed condition. As a result, the right and left movable plates 13 approach to each other to press the tubular packaging material 2 (see the lower portions in FIGS. 4 and 5).

When the turning of the forming arms 12 is completed, a forming flap having a rectangular shape in cross section is formed by the opposing fixed plates 11 and the opposing pair of right and left movable plates 13. The tubular packaging material is shaped in a rectangular shape in cross section by this forming flap.

At this time, when the turning angle of the forming arms 12 is adjusted in advance, the inner capacity of the rectangular parallelepiped body can be finely adjusted since the amount of volume of the rectangular parallelepiped body, which is the shape of the final product of the tubular packaging material, is determined by the distance between the right and left movable plates 13 when they approach to each other.

Before the lateral seal bar 1 further lowers to release the nipping of the tubular packaging material, the contact between the cam follower 27 and plate cam 28 is released so that a pair of right and left forming arms 12 turn in a direction to increase the angle defined therebetween by the resilient force of the spring 25, and at the same time the right and left movable plates 13 also turn in a direction to move away from each other, and hence they are respectively shunted in a position not to interfere with the tubular packaging material. Thereafter, the lateral seal bar 1 releases the tubular packaging material in the vicinity of the bottom dead center and it rises again, and hence these operations are repeated.

The following embodiments are also included in the present invention although the preferred embodiment has been explained so far.

Although the other forming arm is interlocked with one forming arm to be turned according to the preferred embodiment, they may be turned independently or they may be turned by replacing them with a cam mechanism and using fluid pressure.

According to the preferred embodiment, a pair of forming arms are provided at the right and left over the lateral seal bar 1, namely, four forming arms are provided and the movable plates are provided on each of the four forming arms wherein each plate has a width which is substantially half of the width of the rectangular parallelepiped body as the shape of the final product of the container. However, it is possible to reduce the number of plates to two while the width of each movable plate is the same as that of the rectangular parallelepiped body. In this case, the forming arms may be provided by pairing them at the right and left over one of the lateral seal bars or the forming arms may be provided one by one over each of the lateral seal bars 1. In this system using two movable plates, the accuracy of the forming is inferior to that of the preferred embodiment.

According to the present invention, a soft packaging material such as paper is not at all nipped in the longitudinal direction thereof and the surface of a packaging material web will not be damaged. Further, since the container having an accurate rectangular shape in cross section can be obtained, the inner capacity of the container is made proper and also the amount of volume of the container can be finely adjusted.

What is claimed is:

1. A method of forming package containers comprising the steps of:

providing a package container forming flap apparatus including lateral seal bars, a pair of opposing fixed plates, forming arms, and movable plates, wherein the pair of opposing fixed plates are disposed over the lateral seal bars in parallel with a seal surface of the lateral seal bars, and the movable plates are secured to the forming arms, the forming arms pivoting about axes which are parallel with a longitudinal direction of the tubular packaging material, and the forming arms being connected to the lateral seal bars;

forming the tubular packaging material to have a rectangular cross section with the forming flap apparatus wherein the movable plates each form at least one side of the rectangular shape and the fixed plates each form at least one other side of the rectangular shape; and laterally sealing the tubular packaging material with the lateral seal bars of the forming flap apparatus.

2. The method of forming package containers according to claim 1, further comprising the step of adjusting a closing angle defined between the forming arms about the tubular packaging material to adjust a container capacity of a formed package container.

3. The method of forming package containers according to claim 2, wherein said forming step includes the steps of:

pressing the fixed plates against the tubular packaging material, and rotating the forming arms to close the movable plates to complete the rectangular shape of the package.

4. A package container forming flap apparatus comprising:

lateral seal bars for laterally sealing a tubular packaging material, the lateral seal bars each having a seal surface, a pair of opposing fixed plates which are disposed over each lateral seal bar in parallel with the seal surface of the lateral seal bars, forming arms connected to the lateral seal bars, each forming arm being pivotable along on axis that is parallel to a longitudinal direction of the tubular packaging material, and moveable plates secured to the forming arms, wherein the movable plates together with the fixed plates shape the tubular packaging material in a rectangular shape in cross section such that the movable plates each form at least one side of the rectangular shape and the fixed plates each form at least one other side of the rectangular shape.

5. The package container forming flap apparatus according to claim 4, wherein the apparatus further comprises:

a cam mechanism connected to one of the forming arms, and wherein the forming arms are paired such that the forming arms are on opposing sides of the tubular packaging material, a first forming arm of a pair is turned by the cam mechanism, and a second forming arm of the pair is interlocked with the first forming arm such that the first and second forming arms pivot about their respective axes in opposite directions.

6. The package container forming flap apparatus according to claim 4, further comprising a means for moving the movable plates to a position remote from the tubular packaging material.

7. The package container forming flap apparatus according to claim 4, wherein the fixed plates have rollers for guiding the tubular packaging material.

8. The package container forming flap apparatus according to claim 4, wherein each fixed plate has a surface with a central portion, the central portion contacting the tubular packaging material.

9. A filling and packaging apparatus comprising a package container forming flap apparatus, said forming flap apparatus including:

lateral seal bars for laterally sealing a tubular packaging material, the lateral seal bars having a seal surface, a pair of opposing fixed plates which are disposed over each lateral seal bar in parallel with the seal surface of the lateral seal bars, forming arms connected to the lateral seal bars, each forming arm being pivotable along an axis that is parallel to a longitudinal direction of the tubular packaging material, and movable plates secured to the forming arms, and wherein the movable plates together with the fixed plates shape the tubular packaging material in a rectangular shape in cross section such that the movable plates each form at least one side of the rectangular shape and the fixed plates each form at least one other side of the rectangular shape.

10. A package forming flap apparatus comprising:

lateral seal bars each having a seal surface, and two clamping devices connected to said lateral seal bars, each of said clamping devices including a support structure, a first forming arm pivotally connected to said support structure, a first bolt connecting said first forming arm to one of said lateral seal bars, said first bolt providing a pivot point for said first forming arm, a second forming arm pivotally connected to said support structure, said second forming arm being connected to said first forming arm, a second bolt connecting said second forming arm to one of said lateral seal bars, said second bolt providing a pivot point for said second forming arm, a fixed plate connected to said support structure, said fixed plate being parallel to one of said seal surfaces, and a pair of movable plates respectively connected to one of said first forming arm and said second forming arm, said pair of movable plates being on opposing sides of said fixed plate and being perpendicular to said fixed plate when said pair of movable plates is in operative position, wherein said first forming arm and said second forming arm rotate in opposite directions about their respective pivot points; and wherein each of said two clamping devices forms half of a rectangular shape of a produced package.

11. The package forming flap apparatus according to claim 10, further comprising a cam unit connected to said first forming arm.

12. The package flap forming flap apparatus according to claim 8, wherein each movable plate has a central portion for contacting the tubular packaging material.

13. The package flap forming flap apparatus according to claim 4, wherein each movable plate has a central portion for contacting the tubular packaging material.

* * * * *